US010189609B2

(12) United States Patent
Pellingra et al.

(10) Patent No.: US 10,189,609 B2
(45) Date of Patent: Jan. 29, 2019

(54) POUCH WITH RIGID HANDLE AND SUPPORTS

(71) Applicant: AMPAC HOLDINGS, LLC, Cincinnati, OH (US)

(72) Inventors: Salvatore Pellingra, Newport, KY (US); Allyson Smith, Cincinnati, OH (US)

(73) Assignee: AMPAC HOLDINGS, LLC, Cincinnati, OH (US)

( * ) Notice: Subject to any disclaimer, the term of this patent is extended or adjusted under 35 U.S.C. 154(b) by 0 days.

(21) Appl. No.: 14/672,537

(22) Filed: Mar. 30, 2015

(65) Prior Publication Data

US 2015/0239618 A1 Aug. 27, 2015

Related U.S. Application Data

(62) Division of application No. 13/673,293, filed on Nov. 9, 2012, now Pat. No. 8,992,084.

(Continued)

(51) Int. Cl.
*B65D 33/06* (2006.01)
*B65D 33/02* (2006.01)

(Continued)

(52) U.S. Cl.
CPC ..... *B65D 33/06* (2013.01); *B31B 41/00* (2013.01); *B65B 1/02* (2013.01); *B65B 67/1238* (2013.01);

(Continued)

(58) Field of Classification Search
CPC ..... B65D 33/065; B65D 33/02; B65D 33/25; B65D 33/06; B65D 33/12; B65D 33/1616;

(Continued)

(56) References Cited

U.S. PATENT DOCUMENTS 866,275 A 9/1907 Hartmann
3,238,984 A 3/1966 Shurtleff et al.

(Continued)

FOREIGN PATENT DOCUMENTS

GB 802292 A * 10/1958 ..... B29C 37/0085
GB 2305906 4/1997

(Continued)

OTHER PUBLICATIONS

Machine translation of the description of WO9316928.*

(Continued)

*Primary Examiner* — Jes F Pascua
(74) *Attorney, Agent, or Firm* — Perman & Green, LLP

(57) ABSTRACT

Provided are pouches with rigid handles and/or internal supports and methods of making such pouches. In one aspect, a pouch with internal support includes a flexible pouch including a fitment coupled to a flexible pouch body and at least one inner support piece coupled to the fitment and extending into the inside of the pouch through the interior of the fitment. The fitment includes a fitment inner engagement feature and the at least one inner support piece includes an inner support engagement feature and at least one inner support extending from the inner support engagement feature. The fitment inner engagement feature and inner support engagement feature are interlocked to keep the at least one inner support piece from falling into or out of the flexible pouch body.

14 Claims, 10 Drawing Sheets

Related U.S. Application Data

(60) Provisional application No. 61/558,754, filed on Nov. 11, 2011.

(51) Int. Cl.

| | |
|---|---|
| ***B65D 33/25*** | (2006.01) |
| ***B65B 67/12*** | (2006.01) |
| ***B31B 41/00*** | (2006.01) |
| ***B65B 1/02*** | (2006.01) |
| ***B65D 33/12*** | (2006.01) |
| ***B65D 33/16*** | (2006.01) |
| ***B65D 75/00*** | (2006.01) |
| ***B65D 75/52*** | (2006.01) |
| ***B65D 75/56*** | (2006.01) |
| ***B65D 75/58*** | (2006.01) |
| ***B65D 57/00*** | (2006.01) |

(52) U.S. Cl.
CPC ..... *B65D 33/02* (2013.01); *B65D 33/065* (2013.01); *B65D 33/12* (2013.01); *B65D 33/1616* (2013.01); *B65D 33/25* (2013.01); *B65D 57/00* (2013.01); *B65D 75/008* (2013.01); *B65D 75/52* (2013.01); *B65D 75/566* (2013.01); *B65D 75/5883* (2013.01); *Y10S 383/906* (2013.01)

(58) Field of Classification Search
CPC .. B65B 67/1238; B31B 41/00; Y10S 383/906
USPC ..... 383/6, 7, 10, 12, 17–20, 25–27, 80, 104, 383/107, 108, 119, 906; 222/106, 107, 222/566, 92
See application file for complete search history.

(56) References Cited

U.S. PATENT DOCUMENTS

| | | | | |
|---|---|---|---|---|
| 3,537,109 | A | 11/1970 | Spurrier et al. | |
| 3,740,770 | A * | 6/1973 | Villari | A61F 5/441 248/95 |
| 4,509,643 | A | 4/1985 | Rhee | |
| 4,637,934 | A | 1/1987 | White | |
| D288,961 | S * | 3/1987 | Andersen | D24/118 |
| 4,898,301 | A | 2/1990 | Schick | |
| 4,946,292 | A | 8/1990 | Diamond et al. | |
| 4,978,025 | A | 12/1990 | Fougeres | |
| 5,027,748 | A | 7/1991 | Wolak | |
| 5,292,093 | A | 3/1994 | Shumake | |
| 5,305,920 | A * | 4/1994 | Reiboldt | B65D 83/0055 222/105 |
| 5,423,611 | A | 6/1995 | Sherrard | |
| 5,439,146 | A | 8/1995 | Niss | |
| 5,615,791 | A * | 4/1997 | Vatelot | B65D 1/0292 215/382 |
| 5,964,533 | A | 10/1999 | Ziglar | |
| 6,105,821 | A * | 8/2000 | Christine | B65D 77/065 222/105 |
| 6,991,121 | B1 | 1/2006 | Kipperman et al. | |
| 7,159,742 | B2 | 1/2007 | Lee | |
| 7,395,947 | B2 | 7/2008 | Drennow | |
| 8,992,084 | B2 * | 3/2015 | Pellingra | B65D 33/065 222/106 |
| 2003/0094464 | A1 * | 5/2003 | Decottignies | B05B 11/0005 222/105 |
| 2003/0183639 | A1 | 10/2003 | Winckels | |
| 2007/0051746 | A1 * | 3/2007 | De Laforcade | B65D 75/5883 222/107 |
| 2007/0221607 | A1 | 9/2007 | Piccioli et al. | |
| 2011/0044567 | A1 | 2/2011 | Barbaroux et al. | |

FOREIGN PATENT DOCUMENTS

| | | | |
|---|---|---|---|
| JP | 2010083562 | A * | 4/2010 |
| WO | 9222234 | | 12/1992 |
| WO | 9316928 | | 9/1993 |

OTHER PUBLICATIONS

Machine translation of the description of JP 2010083562 A.*
International Search Report, International Application No. PCT/US2012/064605, dated Mar. 18, 2013.

* cited by examiner

POUCH WITH RIGID HANDLE AND SUPPORTS

CROSS-REFERENCE TO RELATED APPLICATIONS

This is a divisional application of application Ser. No. 13/673,293, filed Nov. 9, 2012, which claims the benefit of U.S. Provisional Application No. 61/558,754, filed Nov. 11, 2011, all of which are incorporated by reference herein in their entirety.

BACKGROUND

1. Field

The present disclosure relates to a system for flexible pouches with fitments, more particularly, to flexible pouches having fitments with integrated handles and internal supports.

2. Brief Description of Related Developments

Generally, rigid containers are often used to handle liquid or flowable contents. However, it is also possible to use pouches with handles. However, pouches with handles often are difficult to manufacture or produce. In addition, current flexible pouches with handles are difficult to display and use because the pouches lack support.

For instance, existing pouches with handles typically are the result of die cutting and heat sealing of films—for instance, where a handle is cut directly into a pouch material and heat sealed. However, these pouch handles are often not stiff or rigid enough and are difficult to handle. Handling of such pouches may result in deformation of the shape of the pouch as well as the handle. In other types of die-cut and heat sealed handles for pouches, the handles may lose stiffness as the contents of the pouches are reduced, where the contents are no longer able to provide the necessary means to maintain the stiffened pouch handle. Other pouches with handles attempt to solve the problem by using a rigid handle piece sealed within a side cavity of the pouch. However, such pouches are often not ergonomic and difficult to handle. For instance, the handling of such pouches may be very different from how one would handle a rigid container with a handle, which may be difficult for a consumer to use. Such designs may result in more spillage or accidents during handling as the pouch deforms in unexpected ways. Yet other pouches with handles are formed with air bladders formed to be used as handles. For instance, such pouches may be formed by creating an empty space within the pouch that can be filled with air to create a handle. While such a pouch handle may be capable of retaining its shape and stiffness, this is often extremely expensive and difficult to manufacture, often requiring new or specialized equipment. It is desirable to have a pouch with a handle which avoids one or more of the aforementioned disadvantages.

Pouches, especially pouches where a structural shape is important, also are often made of a rigid, stiff material. Such rigid, stiff pouches are often important for retention of a shape or structure. However, such pouches also contribute to excess cost in manufacturing, transporting, handling, and disposing. It is desirable to have a pouch which retains its shape and structural rigidity without resorting to use of rigid, stiff materials to maintain its shape, allowing for lighter weight pouches which are easier to manufacture, handle and transport.

BRIEF DESCRIPTION OF THE DRAWINGS

The foregoing aspects and other features of the present disclosed embodiment are explained in the following description, taken in connection with the accompanying drawings, wherein.

DETAILED DESCRIPTION OF THE EXEMPLARY EMBODIMENTS

Figure 1:
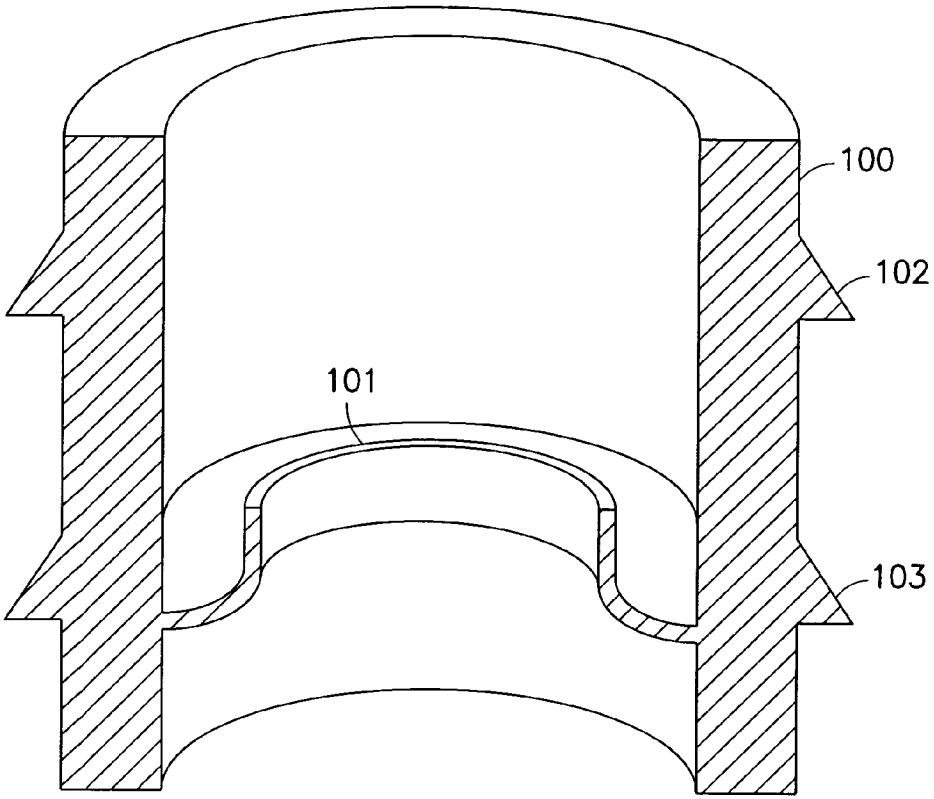
FIG. 1 is a cutaway schematic view of a fitment in view of an aspect of the exemplary embodiment.

FIG. 1 illustrates an exemplary schematic diagram illustrating a pouch with a rigid handle and supports. Although the present invention will be described with reference to the embodiment shown in the drawings, it should be understood that the present exemplary embodiments can be used individually or in any suitable combination thereof. Although the aspects of the disclosed embodiment will be described with reference to the drawings, it should be understood that the aspects of the disclosed embodiment can be embodied in many alternate forms. In addition, any suitable size, shape or type of elements or materials could be used.

FIG. 1 illustrates an exemplary cutaway schematic of a fitment 100. As may be seen in FIG. 1, fitment 100 may be a substantially annular or cylindrical shape in one aspect of the disclosed embodiment. However, in alternate aspects of the disclose embodiment, fitment 100 may be of any suitable fitment shape, including oval or rectangular shapes. Generally, the shape of the fitment 100 is not important, although for ease of understanding, fitment 100 will be described as an annular fitment, as seen in FIG. 1. Generally, a fitment 100 may be formed from a rigid material or any other semi-rigid, flexible or elastic support material rigid enough to maintain structural support. More particularly, the fitment material is equal to or greater in stiffness relative to the flexible pouch body. Alternatively, the fitment material is greater in stiffness relative to the flexible pouch body. Still alternatively, the fitment material is greater in stiffness relative to the flexible pouch body by at least 5%, or at least 10%, or at least 15%, or at least 20%, or at least 25%, or at least 30%, or at least 40%, or at least 50%.

In one aspect, fitment 100 may be molded of any suitably rigid material, including high density polyethylene (HDPE), polypropylene (PP), molded pulp, wood, or any other similar suitable material. In alternate aspects of the disclosed embodiment, the fitment 100 may be formed from any suitable rigid material, including metal, glass, ceramics, wood or anything which is rigid enough to maintain the shape of the fitment. As may be seen, fitment 100 may have engagement features 102, 103. Engagement features 102, 103 may be configured to engage a cap (not shown) or other form of closure for fitment 100. In other aspects, engagement features 102, 103 may engage anything which may be configured to engage with the fitment.

Referring still to FIG. 1, fitment 100 may also have an inner engagement feature 101. As may be seen in FIG. 1, the inner engagement feature 101 may be, for instance, an inner lip which substantially runs around the inside of the fitment 100 such that it is able to engage with a handle engagement feature 104, which will be described in further detail below. In alternate aspects of the disclosed embodiment, the inner engagement feature 101 may be any other suitable means for engaging with a handle engagement feature. For example, in one aspect, the inner engagement feature 101 may be a clip, or a clasp, or a friction-held engagement part. In other aspects, the inner engagement feature 101 may be any suitable means for engaging a handle engagement feature. The inner engagement feature 101 may be molded directly with fitment 100, but in other aspects, may be a separate portion which is joined to the fitment 100 by some other means.

Figure 1A:
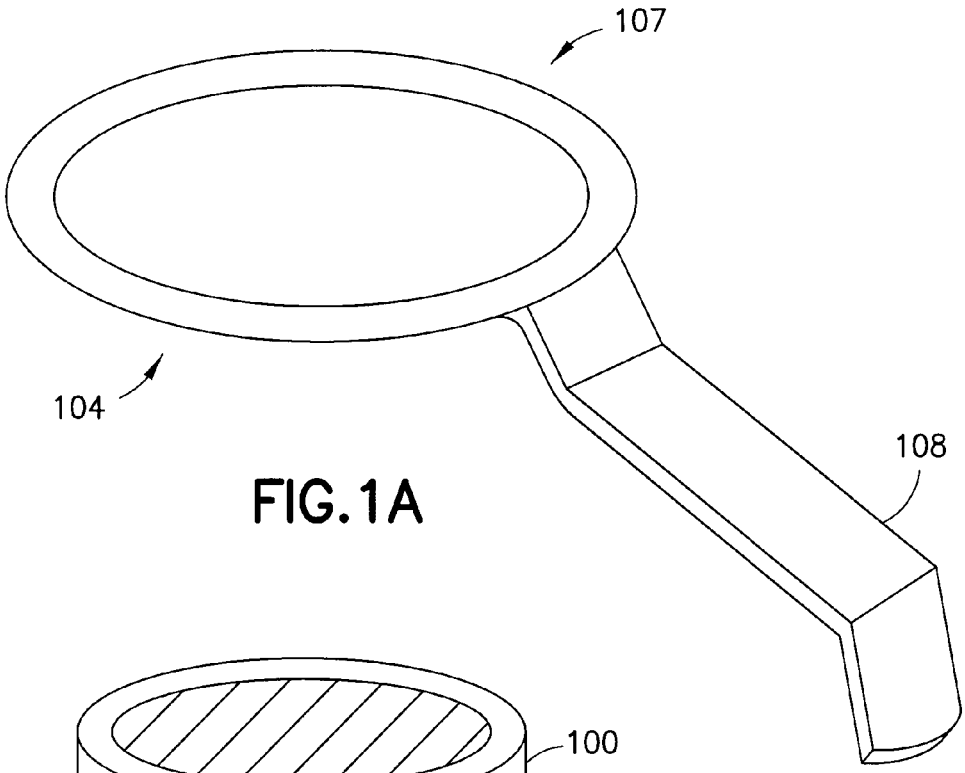
FIG. 1A is a perspective view of a handle piece in view of an aspect of the exemplary embodiment.

Referring now to FIG. 1A, a perspective view diagram of a handle piece 107 is shown. The handle piece 107 may be molded or otherwise formed from a rigid material or any other semi-rigid, flexible or elastic support material rigid enough to maintain structural support. More particularly, the handle piece material is equal to or greater in stiffness relative to the flexible pouch body. Alternatively, the handle piece material is greater in stiffness relative to the flexible pouch body. Still alternatively, the handle piece material is greater in stiffness relative to the flexible pouch body by at least 5%, or at least 10%, or at least 15%, or at least 20%, or at least 25%, or at least 30%, or at least 40%, or at least 50%.

In one aspect, the handle piece material may be HDPE, PP, molded pulp, wood or any other similar materials. However, in other aspects, the material may be any rigid material, including metal, glass, ceramics, wood or any other suitable material rigid enough to maintain its shape. It is noted that the material of the handle piece 107 may be of the same type as the material of fitment 100, but in some aspects, the fitment 100 and handle piece 107 may utilize different materials in their formation.

Referring still to FIG. 1A, the handle piece 107 may have a handle engagement feature 104. As noted above, the handle engagement feature 104 may be substantially coupled with the inner engagement feature 101 of fitment 100 so that, when engaged, the handle piece 107 and fitment 100 become substantially one piece. As can be seen in FIG. 1A, the handle engagement feature 104 is shown to be a substantially ring-shaped engagement feature so as to couple with the inner engagement feature 101 of the annular fitment 100 shown in FIG. 1. However, in alternate aspects, the handle engagement feature 104 may be any may be any sort of suitable engagement feature which complements the inner engagement feature 101. For example, this may include, but is not limited to, a clip, a clasp, or some sort of friction-held engagement feature or any other suitable engagement feature. Though the handle engagement feature 104 is shown as a closed curved section, in alternate aspects of the disclosed embodiments, the handle engagement feature 104 may also be an open sections or any other suitable shape. In one aspect, the handle engagement feature 104 and inner engagement feature 101 may be configured so that the handle engagement feature 104 can lock into the inner engagement feature with minimal force, but afterwards, the locked in such a way that it is difficult to separate the handle engagement feature 104 from the inner engagement feature 101. Handle piece 107 may also have a handle portion 108 which is of unitary construction with the handle engagement feature 104. In one aspect, the handle portion 108 may be in substantially the shape shown in FIG. 1A, but in alternate aspects, the handle portion 108 may take any suitable shape desirable for use as a handle.

Figure 1B:
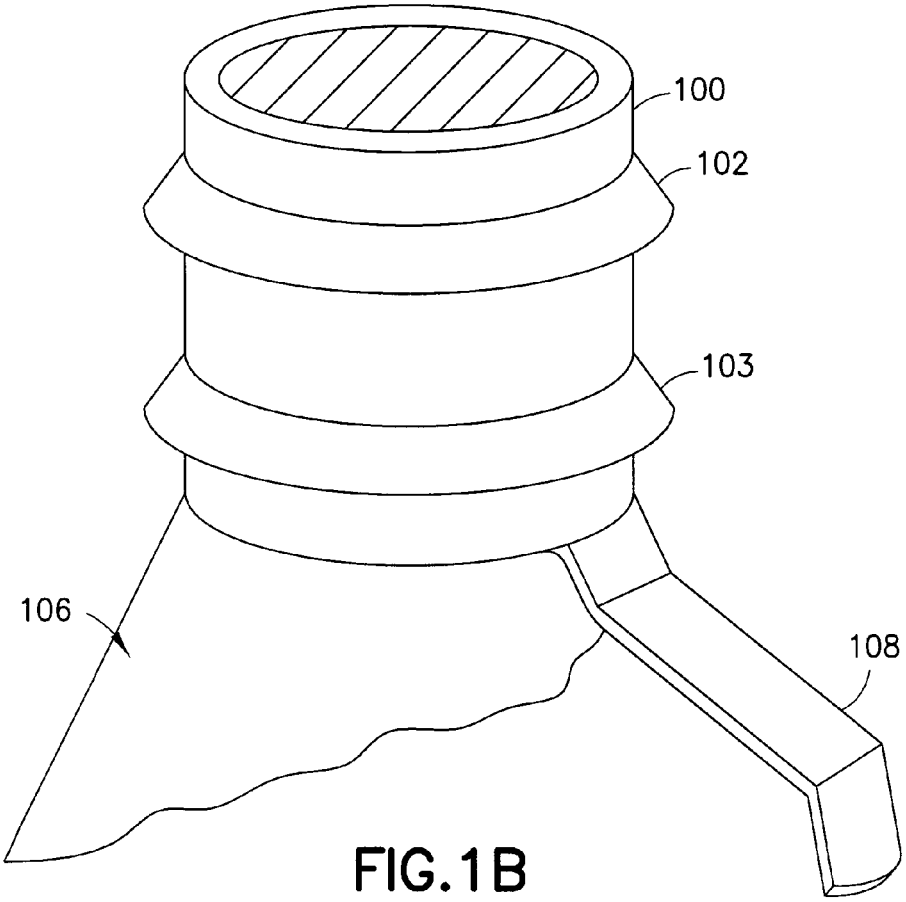
FIG. 1B is a perspective view of a combined fitment and handle piece in view of an aspect of the exemplary embodiment.

Referring now to FIG. 1B, a diagram of the combined fitment and handle piece 100 is shown. As may be understood, the combined fitment and handle piece 100 may be coupled by means of the inner engagement feature 102 and handle engagement feature 103 as described previously. In another aspect, the combined fitment and handle piece 100 is a unitary piece which does not require coupling of an inner engagement feature 102 and a handle engagement feature 103. As can be seen, the joining of combined fitment and handle piece 100 may be accomplished where the handle piece is essentially passed through the center of the fitment so that the handle portion 108 extends from the bottom of fitment 100. Fitment 100 is further attached to a preformed pouch 106 which may be formed so that the preformed pouch 106 extends from the interior of the fitment 100. In alternate aspects, the preformed pouch 106 may also be formed in any other suitable way and may be connected to the fitment 100 by any other suitable means. The preformed pouch 106 may be of any variety or type of pouch in any suitable configuration. In one aspect, the preformed pouch 106 may be formed of a flexible film or any suitable thin-gauged material suitable to be used for a flexible pouch. For example, the pouch may be formed of polypropylene in one aspect, but in other aspect, any suitable materials may be used. The preformed pouch 106 may be heat-sealed to fitment 100. In alternate aspects, the preformed pouch 106 may be attached to the fitment 100 by any suitable means. The handle portion 108 of handle piece 107 may extend into the interior of preformed pouch 106. In alternate aspects, the handle portion 108 may also extend to the exterior of the preformed pouch 106. The pouch 106 may be heat-sealed or otherwise sealed around the handle portion 108 in such a configuration. In yet alternate aspects, any suitable configuration of the handle may be possible.

Figure 2:
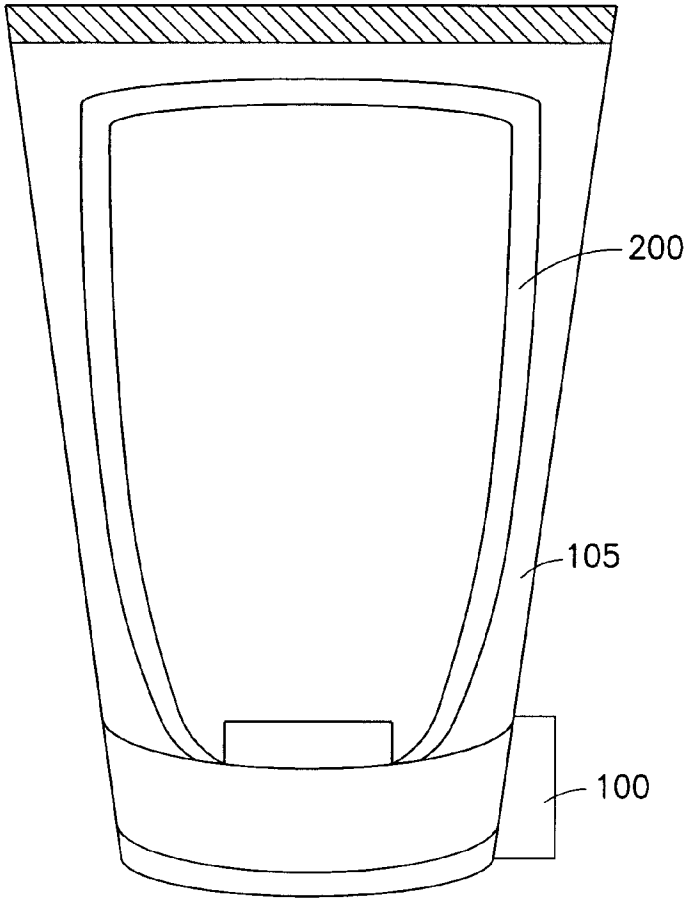
FIG. 2 is a cutaway schematic view of an exemplary pouch in view of an aspect of the exemplary embodiment.

Referring now to FIG. 2, a side cutaway view of a preformed pouch 106 is shown. The pouch 106 shown is in the form of a standup pouch, but in alternate aspects, any suitable pouch configuration may be used. A rigid support 200 is disposed within the preformed pouch 106. The rigid support 200 may provide support for the structure of the preformed pouch 106 so that the preformed pouch 106 may hold a predetermined structure and shape. The rigid supports 200 may also allow for a thin-gauged material to be used for the preformed pouch 106. Thin gauged material may be desirable for transportation, disposal and handling purposes, but may not be rigid or thick enough to maintain a shape or a structure by itself. The rigid supports 200 may be of any suitable material, including HDPE, PP, metal, wood or any other flexible or elastic support material rigid enough to maintain a structural shape within a pouch. More particularly, the rigid support material is equal to or greater in stiffness relative to the flexible pouch body. Alternatively, the rigid support material is greater in stiffness relative to the flexible pouch body. Still alternatively, the rigid support material is greater in stiffness relative to the flexible pouch body by at least 5%, or at least 10%, or at least 15%, or at least 20%, or at least 25%, or at least 30%, or at least 40%, or at least 50%.

The rigid support 200 may be inserted through fitment 100 into body of the preformed pouch 106. In one aspect, the rigid supports 200 may be coupled or attached to the fitment 100 so that it allows for the preformed pouch to maintain its shape during transport. For example, the rigid supports 200 may be coupled with fitment 100 through means of a clip, clasp, friction coupling features or any other suitable coupling feature.

Figure 2A:
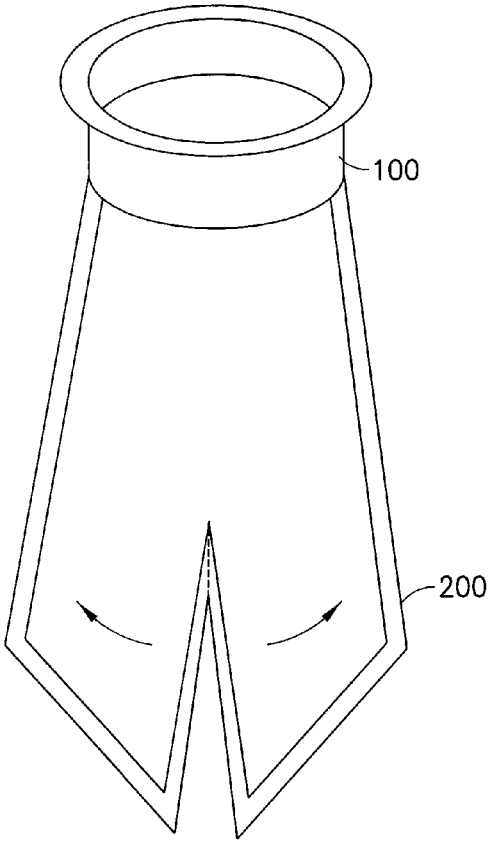
FIG. 2A is a schematic view of an internal support in view of an aspect of the exemplary embodiment.

Referring now to FIG. 2A, a side schematic view of a rigid support 200*a* is shown. The rigid support 200*a* as shown in FIG. 2A is the rigid support 200 in a compressed state. Rigid supports 200 may be configured so that it facilitates easy installation within a pouch. For instance, rigid supports 200 may be initially in a compressed state or compact state as seen in FIG. 2A. The compressed rigid supports 200*a* may facilitate installation so that it allows for easy insertion through a fitment 100, which may be narrower or smaller than an uncompressed rigid support 200 is wide. Compression of the rigid support 200 may be done by any suitable means of compacting or compressing the rigid support 200. The rigid support 200 may be compressible to a compact state by any suitable means, including springs, tension or any other suitable means.

Figure 2B:
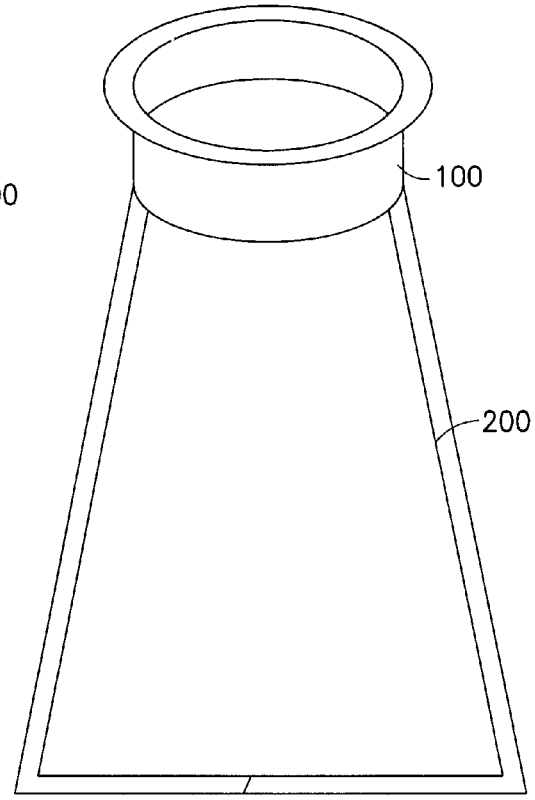
FIG. 2B is a schematic view of an internal support in view of an aspect of the exemplary embodiment.

Referring now to FIG. 2B, a side schematic view of a rigid support 200 in an uncompressed state is shown. As may be seen, the rigid support 200 may change shape or return to its original shape after installation within the pouch (for example, by insertion through a fitment 100). The rigid support 200 may be configured to change shape by any suitable mechanism, including, for example, springs, tension, or any other means. In one aspect, the absence of compression force on rigid support 200 may release tension on the rigid supports 200, allowing the rigid supports 200 to return to an uncompressed shape. This may be, for instance, by means of the elastic nature of the materials used to form the rigid supports 200. In one aspect, the changing of the shape of the rigid support 200 may be done with little or no outside applied force—i.e. the rigid support 200 may change its shape under its own impetus. However, in alternate aspects, any other suitable means for changing the shape of rigid supports 200 may be used.

Figure 3:
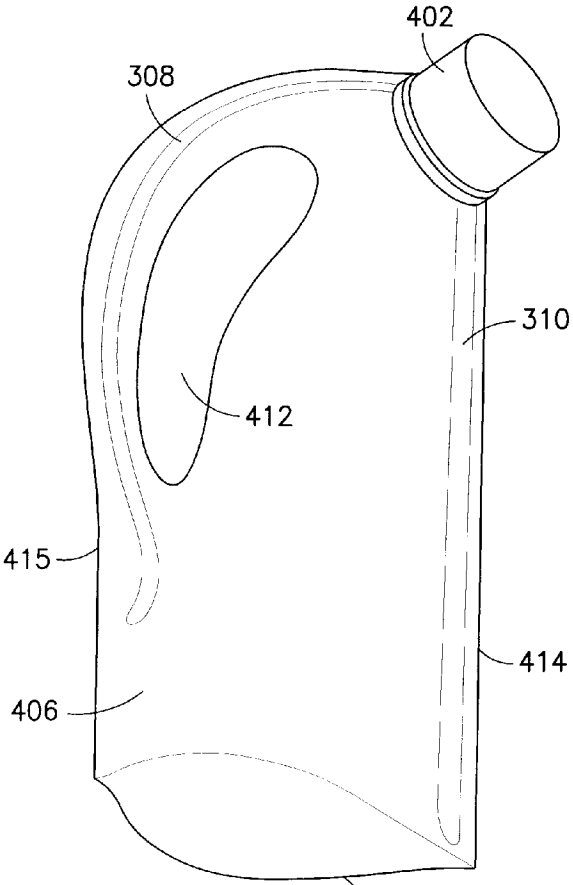
FIG. 3 is a schematic view of an exemplary pouch with an internal support for the handle and an edge in view of an aspect of an exemplary embodiment.

Referring now to FIG. 3, a schematic view of an exemplary bottle pouch 406 with a rigid internal support 300 for the handle region 412 and a front edge 414 is depicted. The bottle pouch 406 includes a fitment 400 for dispensing the contents (not shown) of the bottle pouch 406. The fitment 400 may also include a cap 402 for sealing the contents of the bottle pouch 406. The bottle pouch 406 also includes edge sections 414, 415 as well as a bottom section 416. The bottle pouch 406 may be of any suitable shape for dispensing either solid or liquid contents with the handle 412 functioning to ease the pouring of the bottle pouch 406 contents. Because the bottle pouch 406 is made of a flexible type material, it is generally flimsy, and hence difficult to dispense the liquid or solid contents, and in particular as the remaining contents of the bottle pouch 406 decrease in volume. Hence a rigid internal support 300 is inserted into the bottle pouch 406 to increase its rigidity and improve ease of handling in certain portions of the bottle pouch 406. The exemplary rigid internal support 300 in FIG. 3 includes an engagement feature 304 in its expanded position that locks into the fitment 400 of the bottle pouch 406, a handle portion 308 and a front edge portion 310. The exemplary rigid internal support 300 is internal to the bottle pouch 406 and increases the rigidity in the handle region 412 and the front edge 414 to ease handling of the pouch 406 and the pouring of its contents. The rigid internal support 300 may be of alternative configurations, for example, include a rigid bottom portion to reinforce the bottom 416 of the pouch 406 and/or two or more side edge portions to further reinforce the sides of the pouch.

Figure 3B:
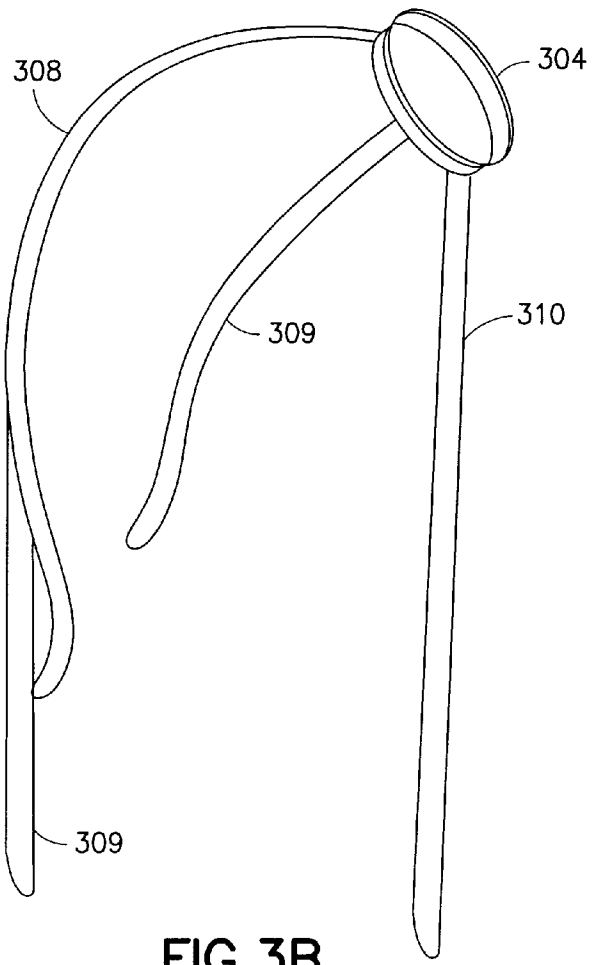
FIG. 3B is a schematic view of an exemplary internal support for the handle region and edge of a pouch in the expanded position in view of an aspect of an exemplary embodiment.
Figure 3A:
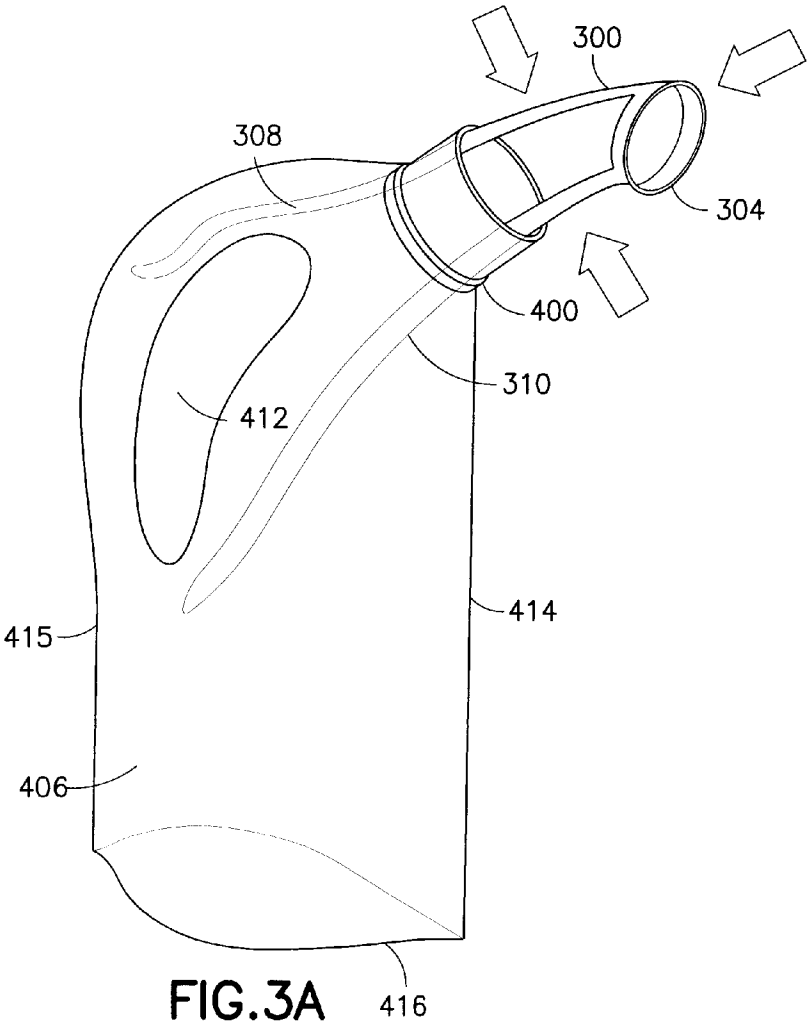
FIG. 3A is a schematic view of an exemplary pouch with an internal support being positioned into the fitment of the pouch in view of an aspect of an exemplary embodiment.

Referring now to FIG. 3A, depicted is a schematic view of an exemplary bottle pouch 406 with a rigid internal support 300 being positioned into the fitment 400 of the pouch 406 in view of an aspect of an exemplary embodiment. The rigid internal support 300 is slid into the bottle pouch 406 through the fitment 400 while it is in an unexpanded position. The engagement feature 304 of the rigid internal support 300 interlocks into the fitment 400 of the pouch 406 to keep it from dropping into it. The rigid internal support 300 includes also the handle portion 308 and the front or side edge portion 310. The handle portion 308 slides into the portion of the pouch 306 adjacent to the handle region 412 to provide rigidity for ease of handling. The side edge portion 310 as it is slid into the pouch 306 expands up against the front edge 414 to provide rigidity to the front edge 414 section of the pouch 306.

Referring now to FIG. 3B, depicted is a schematic view of an exemplary internal support 300 for the handle region 412 and front edge 414 of a bottle pouch 406 in the expanded position in view of an aspect of an exemplary embodiment. The rigid internal support 300 of FIG. 3B is similar to the rigid internal support of FIG. 3 and FIG. 3A, except that it also includes an additional rigid support member 309 for the inside of the handle 412. Hence, there is a rigid support member on both sides 308, 309 of the handle 412. The rigid internal support 300 includes also the engagement member 304, the handle portion 308, 309, and the side edge portion 310. The handle portion of 308 may also be optionally extended via an additional extended leg portion 309 to the bottom 416 or near the bottom 416 of the pouch.

In another form of the embodiments of FIGS. 3, 3A and 3B, the pouch may not have a handle, but the rigid internal supports may still be used to reinforce the edges of the pouch. In yet another form of the embodiments of FIGS. 3, 3A and B, the pouch may have a rigid internal support that includes an engagement feature that locks into the fitment of the pouch and a handle portion.

Figure 4:
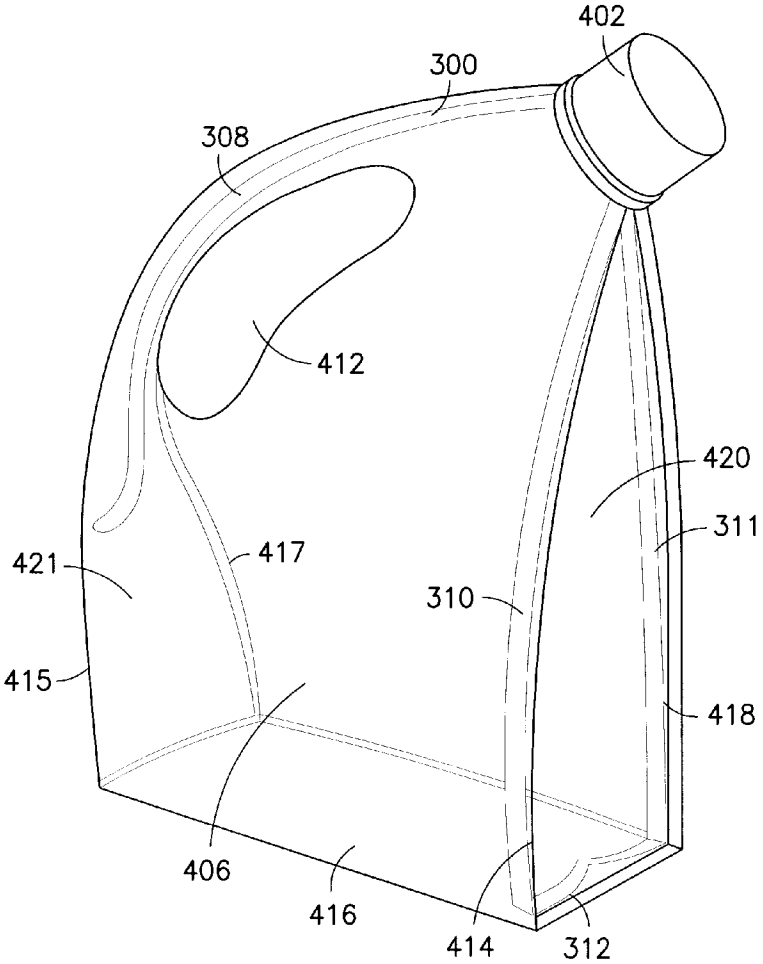
FIG. 4 is a schematic view of an exemplary pouch with an internal support for the handle and a side in view of an aspect of an exemplary embodiment.

Referring now to FIG. 4, a schematic view of another exemplary bottle pouch 406 with a rigid internal support 300 for the handle 412 and the front wall 420 and rear wall 421 is depicted. The bottle pouch 406 includes a fitment 400 for dispensing the contents (not shown) of the bottle pouch 406. The fitment 400 may also include a cap 402 for sealing the contents of the bottle pouch 406. The bottle pouch 406 also includes edge sections 414, 418 for the front vertical wall and edge sections 415, 417 for the rear vertical wall 421 as well as a bottom 416 section. The bottle pouch 406 may be of any suitable shape for dispensing either solid or liquid contents with the handle 412 functioning to ease the pouring of the bottle pouch 406 contents. Because the bottle pouch 406 is made of a flexible type material, it is flimsy and hence difficult to dispense the liquid or solid contents, and in particular as the remaining contents of the bottle pouch 406 decrease in volume. Hence a rigid internal support 300 is inserted into the bottle pouch 406 to increase its rigidity and improve ease of handling in certain portions of the bottle pouch 406. The exemplary rigid internal support 300 in FIG. 4 includes an engagement feature 304 in its expanded position that locks into the fitment 400 of the bottle pouch 406, a handle portion 308 and front vertical wall portion that includes two vertical legs 310, 311 and an optional horizontal leg 312 at or near the bottom front edge 419 of the pouch. The front vertical wall portion includes two vertical legs 310, 311 and an optional horizontal leg 312 that reinforce the front wall 420 of the pouch 406. The exemplary rigid internal support 300 is internal to the bottle pouch 406 and increases the rigidity in the handle 412 and the front wall 420 to ease handling of the pouch 406 and the pouring of its contents.

Figure 4B:
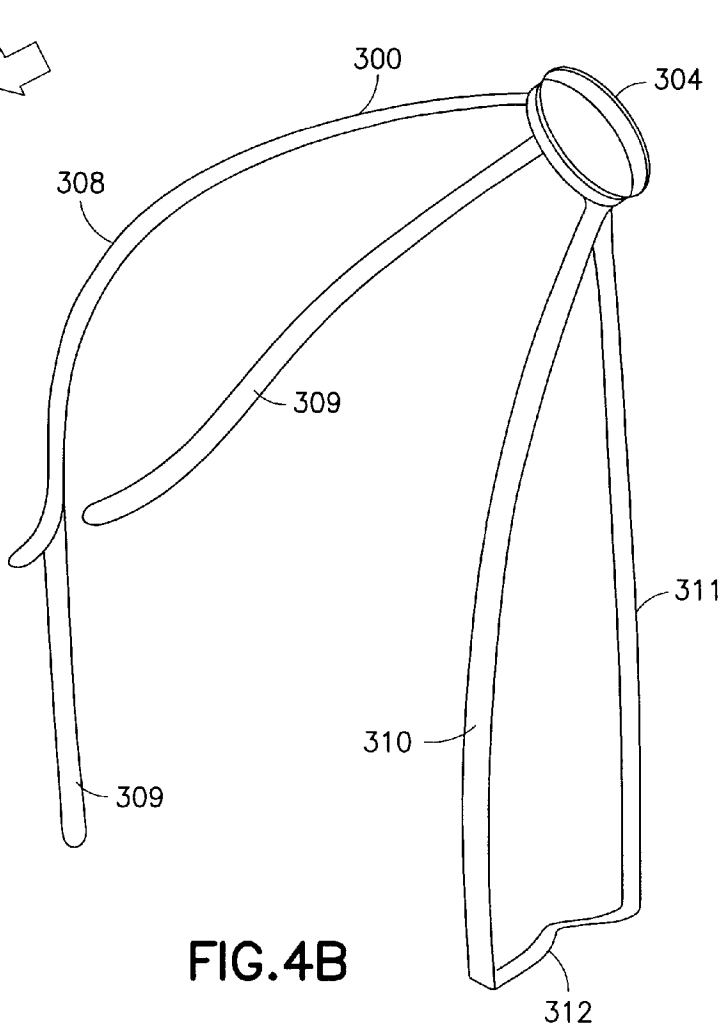
FIG. 4B is a schematic view of an exemplary internal support for the handle region and a side of a pouch in the expanded position in view of an aspect of an exemplary embodiment.
Figure 4A:
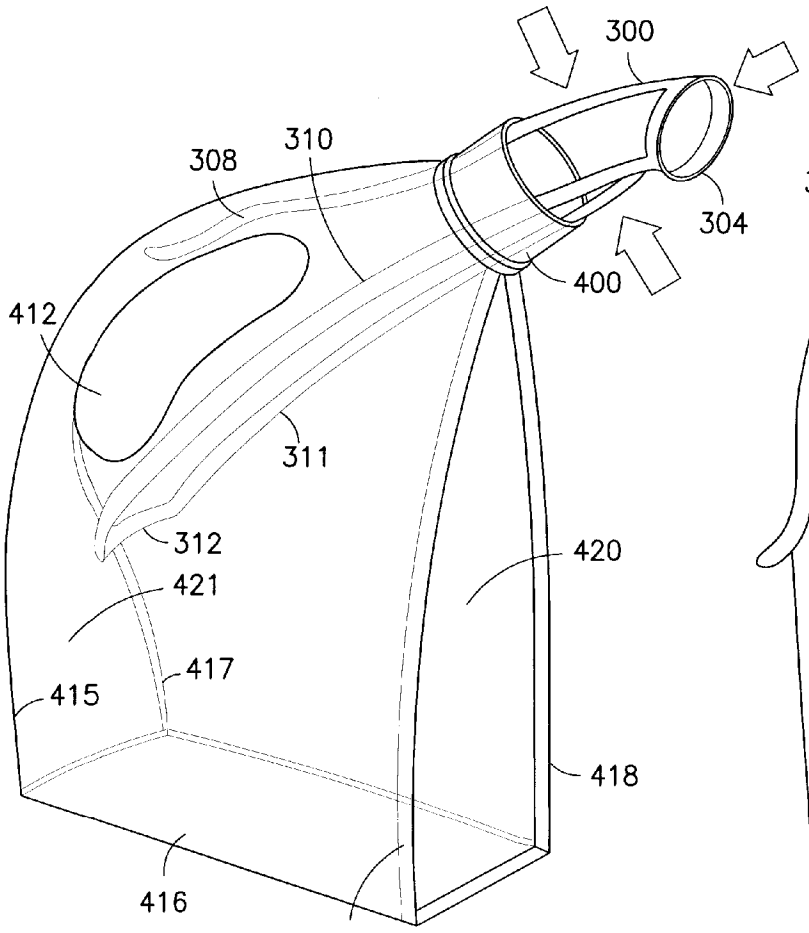
FIG. 4A is a schematic view of an exemplary pouch with an internal support being positioned into the fitment of the pouch in view of an aspect of an exemplary embodiment.

Referring now to FIG. 4A, depicted is a schematic view of an exemplary bottle pouch 406 with a rigid internal support 300 being positioned into the fitment 400 of the pouch 406 in view of an aspect of an exemplary embodiment. The rigid internal support 300 is slid into the bottle pouch 406 through the fitment 400 while it is in an unexpanded position. The engagement feature 304 of the rigid internal support 300 interlocks into the fitment 400 of the pouch 406 to keep it from dropping into it. The rigid internal support 300 includes also the handle portion 308 and front vertical wall portion that includes two vertical legs 310, 311 and an optional horizontal leg 312 at or near the bottom front edge 312 of the pouch 406. The handle portion 308 slides into the portion of the pouch 306 adjacent to the handle 412 to provide rigidity for ease of handling. The front vertical wall portion 310, 311, 312 as it is slid into the pouch 306 expands up against the front vertical wall 414 to provide rigidity to the front of the pouch 306.

Referring now to FIG. 4B, depicted is a schematic view of an exemplary internal support 300 for the handle region 412 and front vertical wall edge portion 310, 311, 312 of a bottle pouch 406 in the expanded position in view of an aspect of an exemplary embodiment. The rigid internal support 300 of FIG. 4B is similar to the rigid internal support of FIG. 4 and FIG. 4A, except that it also includes an additional rigid support member 309 for the inside of the handle 412. Hence, there is a rigid support member on both sides 308, 309 of the handle 412. The rigid internal support 300 includes also the engagement member 304, the handle portion 308 and the front vertical wall portion 310, 311, 312. The handle portion may also be optionally extended via an additional extended leg portion 309 to the or near the bottom 416 of the pouch 406. In another form of the embodiments of FIGS. 4, 4A and 4B, the pouch may not have a handle, but the rigid internal supports may still be used to reinforce the vertical front wall of the pouch. In yet another form of the embodiments of FIGS. 4, 4A and 4B, the pouch may have a rigid internal support that includes an engagement feature that locks into the fitment of the pouch and a handle portion.

Figure 5B:
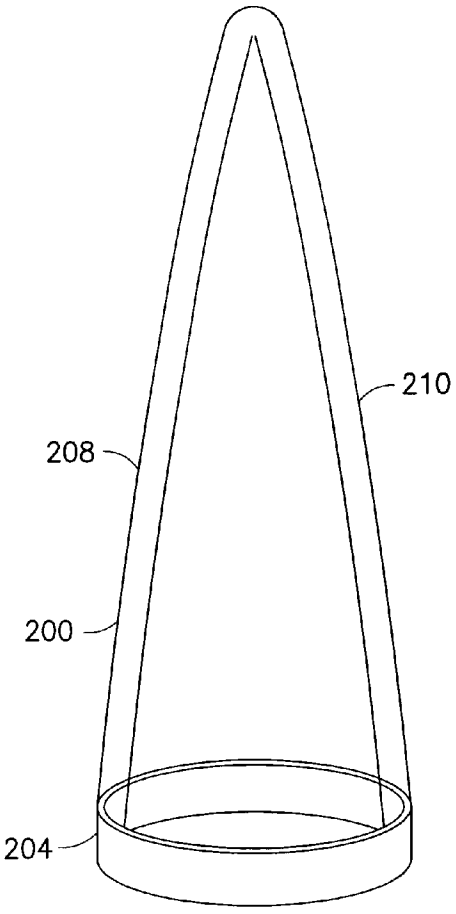
FIG. 5B is a schematic view of an exemplary internal support for the sides and bottom of a tube pouch in view of an aspect of an exemplary embodiment.
Figure 5:
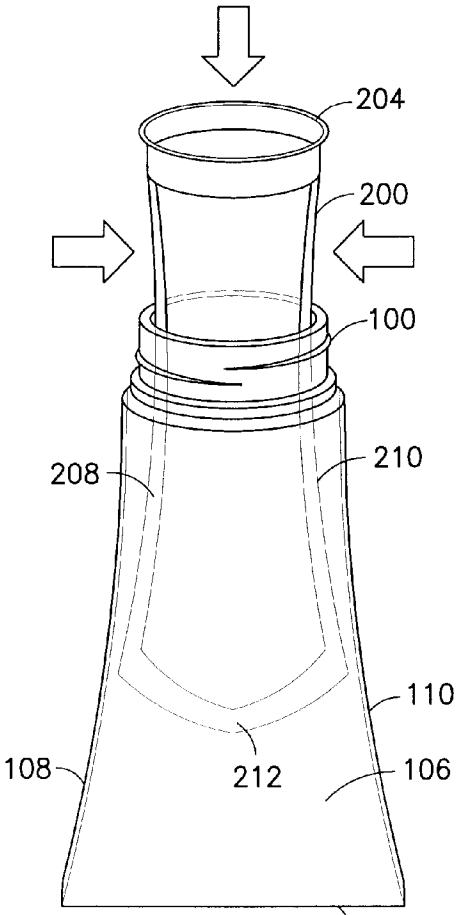
FIG. 5 is a schematic view of an exemplary tube pouch with an internal support being positioned into the fitment of the pouch in view of an aspect of an exemplary embodiment.

Referring now to FIG. 5, depicted is a schematic view of an exemplary tube pouch 106 with a rigid internal support 200 being positioned into the fitment 100 of the pouch 106 for the side edges 108, 110 and optionally bottom edge 112 in view of an aspect of an exemplary embodiment. The tube pouch 106 includes side edges 108, 110 and bottom edge 112 as well as a fitment 100 and a cap (not shown). The tube pouch may contain a liquid (high or low viscosity) or a solid. Without the use of a rigid internal support member 200, the tube pouch is generally flimsy, and in particular, as the contents are consumed. The rigid internal support 200 slides into the fitment 100 opening and the engaging member 204 engages and locks into the fitment 100, for example, as depicted in FIG. 1B. The rigid internal support 200 includes an engaging member 204, side legs 208, 210 and an optional bottom leg 212. The side legs 208, 210 expand against the side edges 108, 110 of the pouch 106 and help reinforce and provide lateral support to this area of the pouch 106. The optional bottom leg 212 expands against the bottom edge 112 and helps reinforce and provide bottom support to this area of the pouch 106.

Figure 5A:
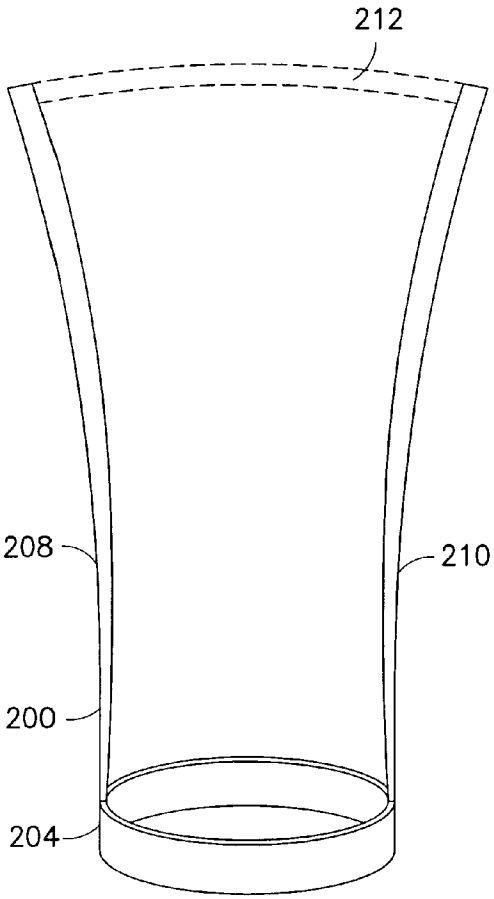
FIG. 5A is a schematic view of an exemplary tube pouch with an internal support for the side edges and optionally bottom of the pouch in view of an aspect of an exemplary embodiment.

Referring now to FIG. 5A, depicted is a schematic view of an exemplary internal support 200 for the sides and optionally bottom of a tube pouch in view of an aspect of an exemplary embodiment. The rigid internal support 200 includes an engaging member 204 for matting to the fitment, side legs 208, 210 and an optional bottom leg 212. After the rigid internal support 200 is slid into the fitment of the tube pouch and held in place by the engaging member 204, the side legs 208, 210 and optional bottom leg 212 expand against the side edges and bottom of the pouch.

Referring now to FIG. 5B, depicted is a schematic view of an exemplary internal support 200 for the sides and optionally bottom of a tube pouch in view of an aspect of an exemplary embodiment. The rigid internal support 200 includes an engaging member 204 for matting to the fitment, and side legs 208, 210 that are connected to each other in the shape of a "V". After the rigid internal support 200 is slid into the fitment of the tube pouch and held in place by the engaging member 204, the side legs 208, 210 expand against the side edges and bottom or near bottom of the pouch. Hence, in this form, there is no lateral support as shown in FIGS. 5 and 5A, but just the two side legs 208, 210, which are connected at the top of the "V".

Figure 6A:
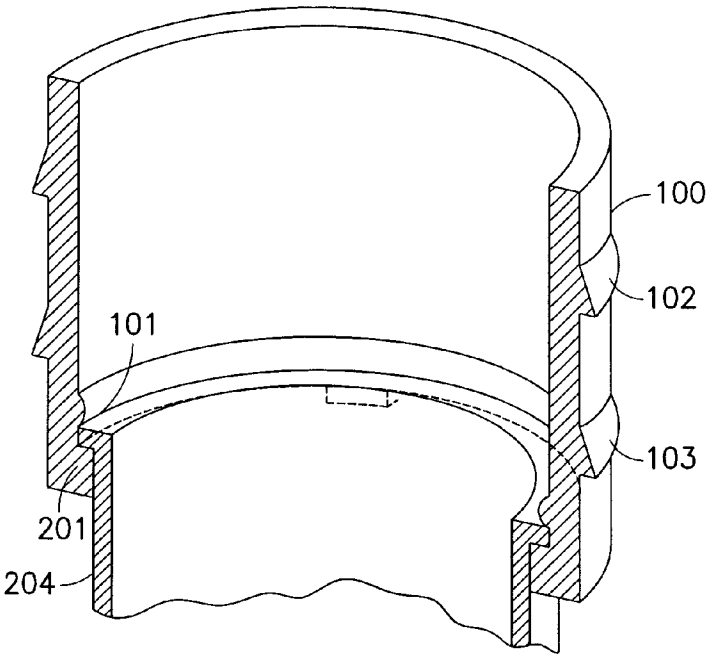
FIG. 6A is a cutaway schematic view of a fitment and internal support positioned into the lip of the fitment in view of an aspect of the exemplary embodiment.
Figure 6:
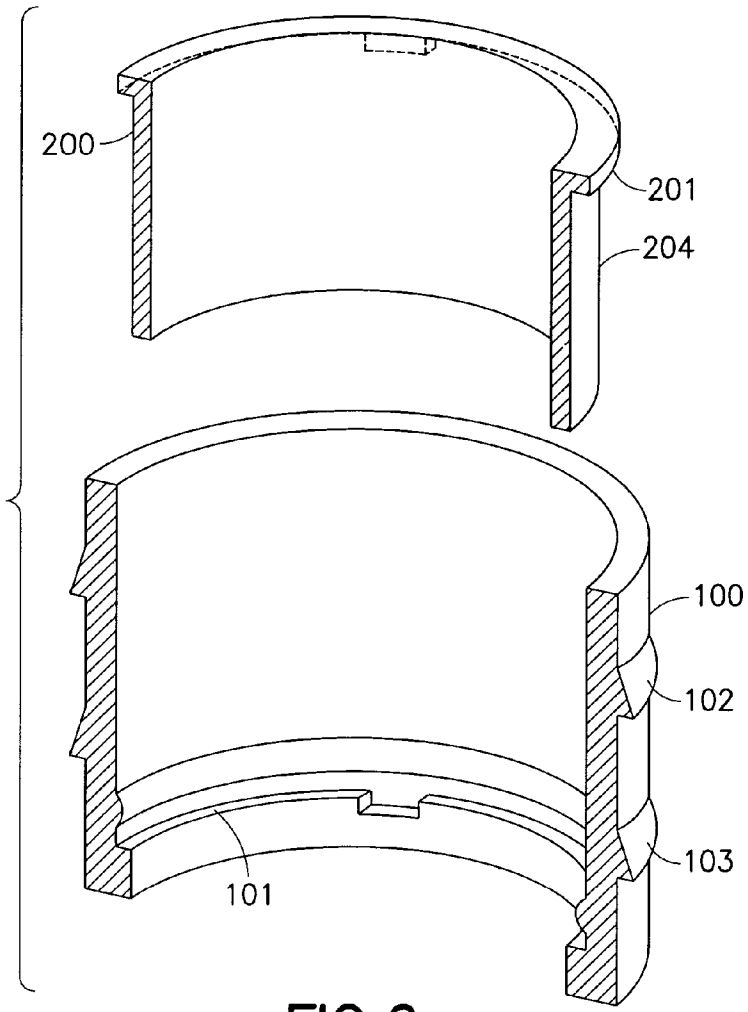
FIG. 6 is a cutaway schematic view of a fitment and internal support being slid into the lip of the fitment in view of an aspect of the exemplary embodiment.

Referring now to FIG. 6, depicted is a cutaway schematic view of a fitment 100 and internal support 200 engaging member 204 being slid into the lip or groove 101 of the fitment 100 in view of an aspect of the exemplary embodiment. The engaging member 204 has an outside diameter that is smaller than the inside diameter of the fitment 100. The engaging member 204 includes a lip 201 that engages the lip or groove 101 on the inside of the fitment 100. The lip 201 of the engaging member snaps into the ridge of the lip 101 of the fitment 100 to keep it in place.

Referring now to FIG. 6A, depicted is a cutaway schematic view of a fitment 100 and internal support 200 engaging member 204 locked into the lip or groove 101 of the fitment 100 in view of an aspect of the exemplary embodiment. The engaging member 204 of the internal support 200 snaps into the fitment 100 by the lip 201 of the engaging member 204 locking into the lip or groove 101 on the inside diameter of the fitment 100. This is one exemplary non-limiting way that the rigid internal support 200 may be connected or locked into the fitment 100 of the pouch, but other similar methods may be contemplated.

Figure 7A:
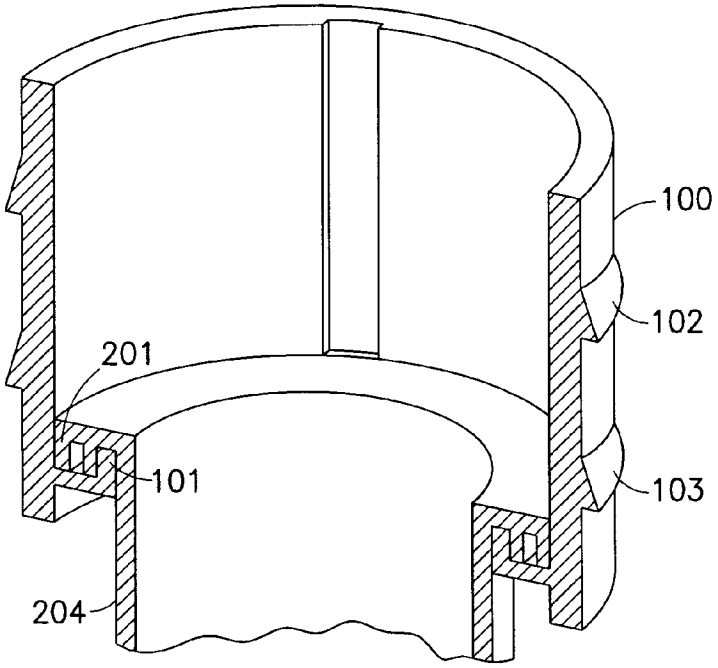
FIG. 7A is a cutaway schematic view of a fitment and internal support positioned into the rail of the fitment in view of another aspect of the exemplary embodiment.
Figure 7:
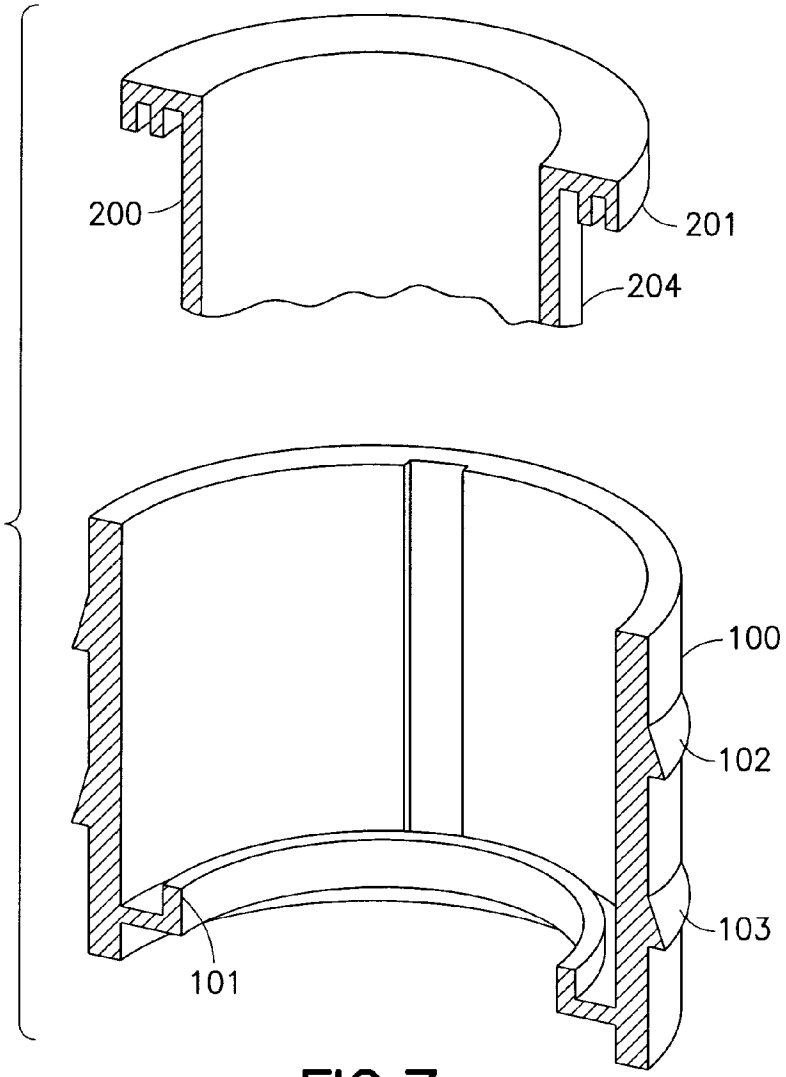
FIG. 7 is a cutaway schematic view of a fitment and internal support being slid into the rail of the fitment in view of another aspect of the exemplary embodiment.

Referring now to FIG. 7, depicted is a cutaway schematic view of a fitment 100 and internal support 200 engaging member 204 being slid into the ridge or channel 101 of the fitment 100 in view of an aspect of the exemplary embodiment. The engaging member 204 has an outside diameter that is smaller than the inside diameter of the fitment 100. The engaging member 204 includes at least one tooth 201 that engages the ridge or channel 101 on the inside of the fitment 100. The at least one tooth 201 of the engaging member 204 locks into the ridge or channel 101 of the lip 101 of the fitment 100 to keep it in place.

Referring now to FIG. 7A, depicted is a cutaway schematic view of a fitment 100 and internal support 200 engaging member 204 locked into the ridge or channel 101 of the fitment 100 in view of an aspect of the exemplary embodiment. The engaging member 204 includes at least one tooth 201 that engages the ridge or channel 101 on the inside diameter of the fitment 100. The at least one tooth 201 of the engaging member 204 locks into the ridge or channel 101 of the lip 101 of the fitment 100 to keep it in place. This is one exemplary non-limiting way that the rigid internal support 200 may be connected or locked into the fitment 100 of the pouch, but other similar methods may be contemplated.

Figure 8:
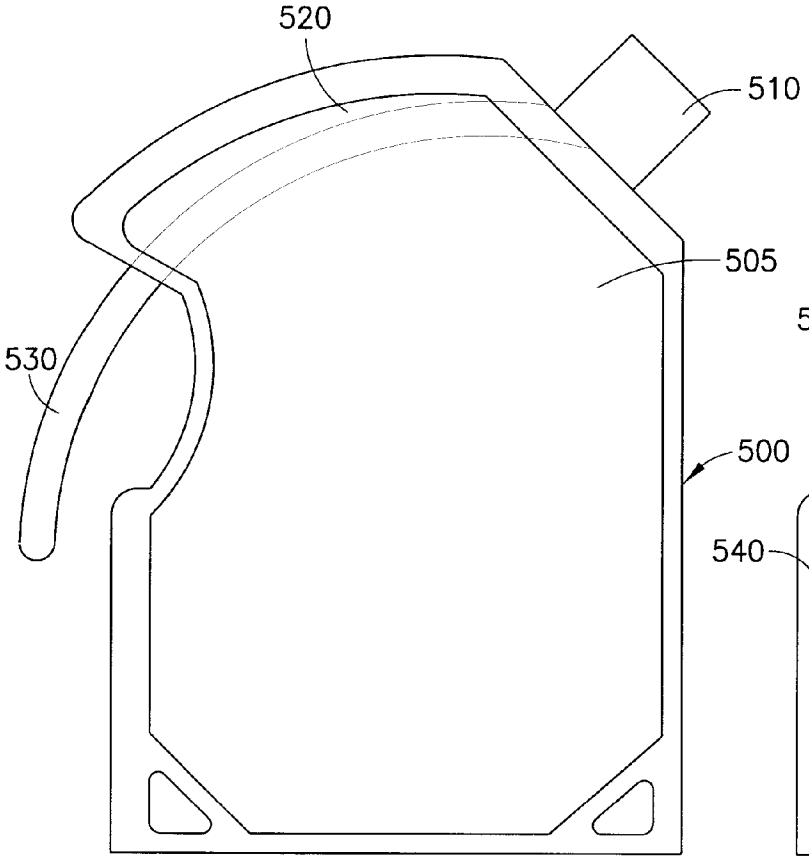
FIG. 8 is a schematic view of an exemplary pouch with an internal and external support for the handle in view of an aspect of an exemplary embodiment.

Referring now to FIG. 8, depicted is a schematic view of an exemplary pouch with an internal and external support for the handle in view of an aspect of an exemplary embodiment. The bottle pouch with an internal support 500 of FIG. 8 includes a flexible pouch body 505 with a fitment 510 coupled to an inner support handle piece 520 extending into the inside of the flexible pouch body 505 through the interior of the fitment 510. The fitment 510 includes a fitment inner engagement feature (not shown) and the inner support handle piece includes an inner support engagement feature (not shown), wherein the fitment inner engagement feature and inner support engagement feature are interlocked to keep the inner support handle piece 520 from falling into or out of the flexible pouch body 505. The inner support handle piece 520 passes from the inside of the bottle pouch 500 to the outside of the bottle pouch 500 to become an outer support handle piece 530. The outer support handle piece 530 functions as a handle for the bottle pouch 500.

Figure 9:
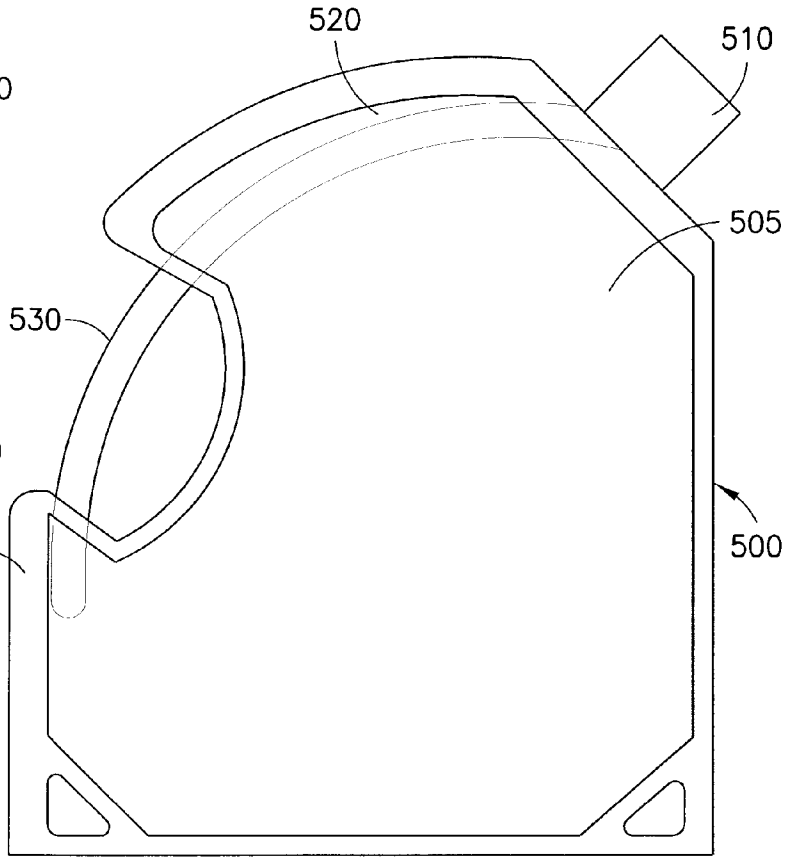
FIG. 9 is another schematic view of an exemplary pouch with an internal and external support for the handle in view of an aspect of an exemplary embodiment.

Referring now to FIG. 9, depicted is a schematic view of another exemplary pouch with an internal and external support for the handle in view of an aspect of an exemplary embodiment. The bottle pouch with an internal support 500 of FIG. 9 includes a flexible pouch body 505 with a fitment 510 coupled to an inner support handle piece 520 extending into the inside of the flexible pouch body 505 through the interior of the fitment 510. The fitment 510 includes a fitment inner engagement feature (not shown) and the inner support handle piece includes an inner support engagement feature (not shown), wherein the fitment inner engagement feature and inner support engagement feature are interlocked to keep the inner support handle piece 520 from falling into or out of the flexible pouch body 505. The inner support handle piece 520 passes from the inside of the bottle pouch 500 to the outside of the bottle pouch 500 to become an outer support handle piece 530. The outer support handle piece 530 then passes back into the inside of the pouch to become a second inner support handle piece 540. The outer support handle piece 530 functions as a handle for the bottle pouch 500.

The pouches with internal supports disclosed herein provide improved stability and control when pouring or dispensing relative to prior art pouches because of having the internal supports coupled to the fitment or spout of the pouch. This feature is not provided by prior art pouches. Even prior art pouches with a handle or other rigid support not coupled to the fitment or spout still lack stability and control during dispensing. The internal rigid support feature coupled to the fitment of the pouches of the present disclosure provide such improved stability and control during dispensing. Additionally, the pouches with internal supports disclosed herein provide support to the flexible pouch body material even when the contents of the pouch are mostly depleted or very light. Prior art pouches without internal supports will collapse or flop without such support, which makes dispensing more difficult as the pouch contents are emptied.

In accordance with one or more aspects of a first disclosed embodiment, a pouch with internal support comprises: a flexible pouch including a fitment coupled to a flexible pouch body and at least one inner support piece coupled to the fitment and extending into the inside of the pouch through the interior of the fitment, wherein said fitment includes a fitment inner engagement feature, wherein the at least one inner support piece includes an inner support engagement feature and at least one inner support extending from the inner support engagement feature, and wherein the fitment inner engagement feature and inner support engagement feature are interlocked.

In accordance with another aspect of the disclosed embodiment, the at least one inner support functions as a handle.

In accordance with another aspect of the disclosed embodiment, the at least one inner support functioning as a handle passes from the inside of the pouch to the outside of the pouch.

In accordance with another aspect of the disclosed embodiment, the at least one inner support functioning as a handle passing from the inside of the pouch to the outside of the pouch passes back into the inside of the pouch.

In accordance with another aspect of the disclosed embodiment, the at least one inner support functions as an edge support.

In accordance with another aspect of the disclosed embodiment, the at least one inner support piece includes two supports.

In accordance with another aspect of the disclosed embodiment, the two supports function as a handle.

In accordance with another aspect of the disclosed embodiment, the two supports function as a handle and as an edge support.

In accordance with another aspect of the disclosed embodiment, the at least one inner support piece includes three supports.

In accordance with another aspect of the disclosed embodiment, two supports function as a handle and one support functions as an edge support.

In accordance with another aspect of the disclosed embodiment, one supports functions as a handle and two supports function as a side support.

In accordance with another aspect of the disclosed embodiment, the fitment is annular, oval or rectangular in shape.

In accordance with another aspect of the disclosed embodiment, the fitment is a semi-rigid, flexible or elastic material.

In accordance with another aspect of the disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the disclosed embodiment, the interlocked fitment inner engagement feature and inner support engagement feature keep the at least one inner support piece from falling into and out of the flexible pouch body.

In accordance with another aspect of the disclosed embodiment, the fitment inner engagement feature is substantially ring shaped.

In accordance with another aspect of the disclosed embodiment, the fitment inner engagement feature is selected from the group the consisting of a lip, a groove, a tongue, a tooth, a channel, a ridge, a clip, and a clasp.

In accordance with another aspect of the disclosed embodiment, the inner support engagement feature is substantially ring shaped.

In accordance with another aspect of the disclosed embodiment, the inner support engagement feature is selected from the group the consisting of a lip, a groove, a tongue, a tooth, a channel, a ridge, a clip, and a clasp.

In accordance with another aspect of the disclosed embodiment, the fitment inner engagement feature is integral to the inside diameter of the fitment or a separate piece press/friction fit into the inside diameter of the fitment.

In accordance with another aspect of the disclosed embodiment, the at least one inner support piece is a semi-rigid, flexible or elastic material that is equal to or greater in stiffness relative to the flexible pouch body.

In accordance with another aspect of the disclosed embodiment, the at least one inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the disclosed embodiment, further including a cap or a dispensing mechanism interconnected to the fitment.

In accordance with another aspect of the disclosed embodiment, the cap or the dispensing mechanism is interconnected to the fitment via a screw-on system, a hinged system or a mechanical coupling system.

In accordance with another aspect of the disclosed embodiment, the dispensing mechanism is selected from the group consisting of a trigger sprayer, a pump, a valve, a push pull spout, a pour back spout, and dispensing ball or bulb for dosing.

In accordance with another aspect of the disclosed embodiment, the flexible pouch body is in the shape of a bottle, jug, a bottle or a tube.

In accordance with another aspect of the disclosed embodiment, the flexible pouch body further includes a liquid, a dry solid, a powdered solid or combinations thereof.

In accordance with another aspect of the disclosed embodiment, the flexible pouch body is coupled to the fitment via a heat seal, an ultrasonic seal or an adhesive seal.

In accordance with another aspect of the disclosed embodiment, the at least one inner support is in a compressed or compacted state prior to being inserted into the flexible pouch body.

In accordance with another aspect of the disclosed embodiment, the at least one inner support in a compressed or compacted state includes springs, tension or a combination thereof.

In accordance with another aspect of the disclosed embodiment, the at least one inner support in a compressed or compacted state expands to conform to the volume of the pouch after being inserted into the flexible pouch body.

In accordance with another aspect of the disclosed embodiment, the at least one inner support piece reinforces at least one portion of the flexible pouch body selected from the group consisting of a handle, a side wall, a side edge, a bottom edge, a top edge, a bottom wall, and combinations thereof.

In accordance with one or more aspects of a second disclosed embodiment, a pouch with an integrated fitment and handle piece comprises: a flexible pouch including a combined fitment and handle piece coupled to a flexible pouch body, wherein the combined fitment and handle piece includes a handle portion extending from the combined fitment and handle piece, and wherein the combined fitment and handle piece are unitary.

In accordance with another aspect of the second disclosed embodiment, the handle portion is in the interior of the pouch.

In accordance with another aspect of the second disclosed embodiment, the handle portion interior to the pouch passes from the interior of the pouch to the exterior of the pouch.

In accordance with another aspect of the second disclosed embodiment, the handle portion interior to the pouch passing from the interior of the pouch to the exterior of the pouch passes back into the interior of the pouch.

In accordance with another aspect of the second disclosed embodiment, the handle portion is exterior of the pouch.

In accordance with another aspect of the second disclosed embodiment, the combined fitment and handle piece are coupled to the flexible pouch body via an adhesive seal, an ultrasonic seal or a heat seal.

In accordance with another aspect of the second disclosed embodiment, the combined fitment and handle piece is a semi-rigid, flexible or elastic material that is equal to or greater in stiffness relative to the flexible pouch body.

In accordance with another aspect of the second disclosed embodiment, the combined fitment and handle piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the second disclosed embodiment, the combined fitment and handle piece reinforces a handle or provides a handle to the flexible pouch body.

In accordance with one or more aspects of a third disclosed embodiment, a pouch with an integrated fitment and inner support piece comprises: a flexible pouch including a combined fitment and inner support piece coupled to a flexible pouch body, wherein the combined fitment and inner support piece includes at least one inner support extending from the combined fitment and inner support piece, and wherein the combined fitment and inner support piece are unitary.

In accordance with another aspect of the third disclosed embodiment, the at least one inner support is in the interior of the pouch.

In accordance with another aspect of the third disclosed embodiment, the combined fitment and inner support piece are coupled to the flexible pouch body via an adhesive seal, an ultrasonic seal, or a heat seal.

In accordance with another aspect of the third disclosed embodiment, the combined fitment and inner support piece is a semi-rigid, flexible or elastic material that is equal to or greater in stiffness relative to the flexible pouch body.

In accordance with another aspect of the third disclosed embodiment, the combined fitment and inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the third disclosed embodiment, the at least one inner support is in a compressed or compacted state prior to being inserted into the flexible pouch body.

In accordance with another aspect of the third disclosed embodiment, the at least one inner support in a compressed or compacted state includes springs, or tension, or combinations thereof.

In accordance with another aspect of the third disclosed embodiment, the at least one inner support in a compressed or compacted state expands to conform to the volume of the pouch after being inserted into the flexible pouch body.

In accordance with another aspect of the third disclosed embodiment, the combined fitment and inner support piece reinforces at least one portion of the flexible pouch body selected from the group consisting of a handle, a side wall, a side edge, a bottom edge, a top edge, a bottom wall and combinations thereof.

In accordance with one or more aspects of a fourth disclosed embodiment, a method of making a pouch with an internal support comprises: i) providing a flexible pouch including a fitment coupled to a flexible pouch body and at least one inner support piece, wherein said fitment includes a fitment inner engagement feature, and wherein the at least one inner support piece includes an inner support engagement feature and at least one inner support extending from the inner support engagement feature; and ii) sliding the inner support piece into the fitment such that the fitment inner engagement feature and the inner support engagement feature interlock to keep the at least one inner support piece from falling into and out of the flexible pouch body.

In accordance with another aspect of the fourth disclosed embodiment, further comprising providing a cap or a dispensing mechanism and interconnecting the cap or the dispensing mechanism to the fitment via a screw-on system, a hinged system or a mechanical coupling system.

In accordance with another aspect of the fourth disclosed embodiment, the dispensing mechanism is selected from the group consisting of a trigger sprayer, a pump, a valve, a push pull spout, a pour back spout, and dispensing ball or bulb for dosing.

In accordance with another aspect of the fourth disclosed embodiment, further including filling the flexible pouch body with a liquid, a dry solid, a powdered solid or combinations thereof.

In accordance with another aspect of the fourth disclosed embodiment, the at least one inner support is in a compressed or compacted state prior to being slid into the fitment.

In accordance with another aspect of the fourth disclosed embodiment, the at least one inner support in a compressed or compacted state includes springs, or tension, or a combination thereof.

In accordance with another aspect of the fourth disclosed embodiment, further including expanding the at least one inner support in a compressed or compacted state to conform to the volume of the pouch after being slid into the fitment.

In accordance with another aspect of the fourth disclosed embodiment, the at least one inner support piece reinforces at least one portion of the flexible pouch body selected from the group consisting of a handle, a side wall, a side edge, a bottom edge, a top edge, a bottom wall, and combinations thereof.

In accordance with another aspect of the fourth disclosed embodiment, the at least one inner support functions as a handle.

In accordance with another aspect of the fourth disclosed embodiment, the at least one inner support functioning as a handle passes from the inside of the pouch to the outside of the pouch.

In accordance with another aspect of the fourth disclosed embodiment, the at least one inner support functioning as a handle passing from the inside of the pouch to the outside of the pouch passes back into the inside of the pouch.

In accordance with another aspect of the fourth disclosed embodiment, the at least one inner support functions as an edge support.

In accordance with another aspect of the fourth disclosed embodiment, the at least one inner support piece includes two supports.

In accordance with another aspect of the fourth disclosed embodiment, the two supports function as a handle.

In accordance with another aspect of the fourth disclosed embodiment, the two supports function as a handle and as an edge support.

In accordance with another aspect of the fourth disclosed embodiment, the at least one inner support piece includes three supports.

In accordance with another aspect of the fourth disclosed embodiment, two supports function as a handle and one support functions as an edge support.

In accordance with another aspect of the fourth disclosed embodiment, one supports functions as a handle and two supports function as a side support.

In accordance with another aspect of the fourth disclosed embodiment, the fitment is annular, oval or rectangular in shape.

In accordance with another aspect of the fourth disclosed embodiment, the fitment is a semi-rigid, flexible or elastic material.

In accordance with another aspect of the fourth disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the fourth disclosed embodiment, the fitment inner engagement feature is substantially ring shaped.

In accordance with another aspect of the fourth disclosed embodiment, the fitment inner engagement feature is selected from the group the consisting of a lip, a groove, a tongue, a tooth, a channel, a ridge, a clip, and a clasp.

In accordance with another aspect of the fourth disclosed embodiment, the inner support engagement feature is substantially ring shaped.

In accordance with another aspect of the fourth disclosed embodiment, the inner support engagement feature is selected from the group the consisting of a lip, a groove, a tongue, a tooth, a channel, a ridge, a clip, and a clasp.

In accordance with another aspect of the fourth disclosed embodiment, the fitment inner engagement feature is integral to the inside diameter of the fitment or a separate piece press/friction fit into the inside diameter of the fitment.

In accordance with another aspect of the fourth disclosed embodiment, the at least one inner support piece is a semi-rigid, flexible or elastic material that is equal to or greater in stiffness relative to the flexible pouch body.

In accordance with another aspect of the fourth disclosed embodiment, the at least one inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the fourth disclosed embodiment, the flexible pouch body is coupled to the fitment via a heat seal, an ultrasonic seal or an adhesive seal.

In yet another aspect of the disclosed embodiment, a pouch is disclosed. The pouch having a fitment comprising an inner engagement feature configured to couple with a handle engagement feature, a handle piece substantially comprising of a handle portion and a handle engagement feature, a pouch body formed by a flexible film material sealed substantially about the fitment, and a support insert. The handle piece is substantially passed through the interior of the fitment such that the inner engagement feature is coupled with the handle engagement feature and wherein the handle portion extends through the bottom of the fitment. The support insert is arranged within the pouch to maintain a shape within.

It should be understood that the foregoing description is only illustrative of the aspects of the disclosed embodiment and that the aspects of the disclosed embodiment can be used individually or in any suitable combination thereof. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

All patents, test procedures, and other documents cited herein, including priority documents, are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

What is claimed is:

1. A bottle pouch with a handle and an integrated fitment and handle piece comprising: a flexible pouch in the shape of a bottle forming a flexible pouch body with a handle region formed from a cut-out in the flexible pouch body including a combined fitment and handle piece coupled to the flexible pouch body, wherein the combined fitment and handle piece includes a rigid handle portion extending from the combined fitment and handle piece, and wherein the combined fitment and handle piece are unitary, and wherein the handle region of the flexible pouch body is reinforced by the rigid handle portion by being adjacent to the handle region and internal in its entirety to the interior of the contents cavity of the flexible pouch body, wherein the rigid handle portion is slid into a portion of the flexible pouch adjacent to the handle region and increases the rigidity in the handle region of the bottle pouch with the proviso that the rigid handle portion is not sealed to the handle region of the flexible pouch body.

2. The bottle pouch of claim 1, wherein the rigid handle portion includes one rigid internal support member for the handle region.

3. The bottle pouch of claim 2, wherein the rigid handle portion includes a second rigid internal support member for the handle region.

4. The bottle pouch of claim 1, wherein the combined fitment and handle piece are coupled to the flexible pouch body via an adhesive seal, an ultrasonic seal or a heat seal at the fitment.

5. The bottle pouch of claim 1, wherein the combined fitment and handle piece is a rigid material that is greater in stiffness relative to the flexible pouch body.

6. The bottle pouch of claim 5, wherein the rigid material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

7. A bottle pouch with a handle and an integrated fitment, handle piece and inner support piece comprising: a flexible pouch in the shape of a bottle forming a flexible pouch body with a handle region formed from a cut-out in the flexible pouch body including a combined fitment, handle piece and inner support piece coupled to the flexible pouch body, wherein the combined fitment, handle piece and inner support piece includes a rigid handle portion and at least one rigid inner support extending from the combined fitment, handle piece and inner support piece, wherein the combined fitment, handle piece and inner support piece are unitary, and wherein the handle region of the flexible pouch body is reinforced by the rigid handle portion by being adjacent to the handle region and internal in its entirety to the interior of the contents cavity of the flexible pouch body, wherein the rigid handle portion and at least one rigid inner support are slid into a portion of the flexible pouch adjacent to the handle region and the rigid handle portion increases the rigidity in the handle region of the bottle pouch with the proviso that the rigid handle portion is not sealed to the handle region of the flexible pouch body.

8. The bottle pouch of claim 7, wherein the rigid handle portion includes one rigid internal support member for the handle region.

9. The bottle pouch of claim 8, wherein the rigid handle portion includes a second rigid internal support member for the handle region.

10. The bottle pouch of claim 7, wherein the combined fitment, handle piece and inner support piece are coupled to the flexible pouch body via an adhesive seal, an ultrasonic seal or a heat seal at the fitment.

11. The bottle pouch of claim 7, wherein the combined fitment, handle piece and inner support piece is a rigid material that is greater in stiffness relative to the flexible pouch body.

12. The bottle pouch of claim 11, wherein the rigid material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

13. The bottle pouch of claim 7, wherein the at least one rigid inner support is internal to the flexible pouch body and increases the rigidity of a front wall of the bottle pouch.

14. The bottle pouch of claim 13, wherein the combined fitment, handle piece and inner support piece further reinforces at least one portion of the flexible pouch body selected from the group consisting of a side wall, a side edge, a bottom edge, a top edge, a bottom wall and combinations thereof.

* * * * *